US009013854B2

(12) United States Patent
Sagues et al.

(10) Patent No.: US 9,013,854 B2
(45) Date of Patent: Apr. 21, 2015

(54) CONFIGURABLE SOLENOID ACTUATION METHOD AND APPARATUS

(75) Inventors: Paul Sagues, Ross, CA (US); Mauritz Botha, Novato, CA (US); Larry Brasfield, Mercer Island, WA (US)

(73) Assignee: XIO, Inc., Ross, CA (US)

( * ) Notice: Subject to any disclaimer, the term of this patent is extended or adjusted under 35 U.S.C. 154(b) by 743 days.

(21) Appl. No.: 13/281,394

(22) Filed: Oct. 25, 2011

(65) Prior Publication Data

US 2012/0099239 A1 Apr. 26, 2012

Related U.S. Application Data

(63) Continuation-in-part of application No. 13/069,292, filed on Mar. 22, 2011, now Pat. No. 8,862,452, which is a continuation-in-part of application No. 12/911,445, filed on Oct. 25, 2010, now abandoned, which is a continuation of application No. 12/106,968, filed on Apr. 21, 2008, now Pat. No. 7,822,896, which is a continuation-in-part of application No. 11/801,127, filed on May 7, 2007, now abandoned, which is a continuation of application No. 11/296,134, filed on Dec. 6, 2005, now Pat. No. 7,216,191, which is a continuation-in-part of application No. 11/043,296, filed on Jan. 25, 2005, now abandoned, which is a continuation-in-part of application No. 10/071,870, filed on Feb. 8, 2002, now Pat. No. 6,892,265.

(60) Provisional application No. 61/406,414, filed on Oct. 25, 2010, provisional application No. 61/316,070, filed on Mar. 22, 2010, provisional application No. 60/950,040, filed on Jul. 16, 2007, provisional application No. 60/269,129, filed on Feb. 14, 2001.

(51) Int. Cl.
*H01H 47/00* (2006.01)
*H01F 7/18* (2006.01)

(52) U.S. Cl.
CPC ..... *H01F 7/1805* (2013.01)

(58) Field of Classification Search
None
See application file for complete search history.

(56) References Cited

U.S. PATENT DOCUMENTS

| | | | | |
|---|---|---|---|---|
| 3,946,285 | A | 3/1976 | Beery et al. | |
| 5,220,903 | A * | 6/1993 | Niemetz | 123/651 |
| 5,402,303 | A * | 3/1995 | Luck et al. | 361/172 |
| 5,426,738 | A | 6/1995 | Hsieh et al. | |
| 5,497,653 | A | 3/1996 | Snow | |
| 5,796,223 | A * | 8/1998 | Ohtsuka et al. | 318/126 |

(Continued)

FOREIGN PATENT DOCUMENTS

| | | |
|---|---|---|
| DE | 10003531 A1 | 7/2001 |
| EP | 1109177 A2 | 6/2001 |

OTHER PUBLICATIONS

International Search Report and Written Opinion for PCT/US2011/57766 issued Feb. 14, 2012.

(Continued)

*Primary Examiner* — Rexford Barnie
*Assistant Examiner* — Terrence Willoughby
(74) *Attorney, Agent, or Firm* — David H. Jaffer; Pillsbury Winthrop Shaw Pittman LLP

(57) ABSTRACT

A configurable, connectorized method and apparatus for driving a solenoid coil reduces energy consumption and heating of the solenoid coil, allows detection of the solenoid state, and simplifies connections to the solenoid.

28 Claims, 12 Drawing Sheets

(56) References Cited

U.S. PATENT DOCUMENTS

| | | | | |
|---|---|---|---|---|
| 5,841,202 | A * | 11/1998 | Noguchi et al. | 307/10.1 |
| 6,294,928 | B1 | 9/2001 | Lytle et al. | |
| 6,657,847 | B1 | 12/2003 | Wright | |
| 6,850,402 | B2 | 2/2005 | Ahrendt | |
| 6,892,265 | B2 | 5/2005 | Sagues et al. | |
| 7,216,191 | B2 | 5/2007 | Sagues et al. | |
| 7,262,950 | B2 | 8/2007 | Suzuki et al. | |
| 7,822,896 | B1 | 10/2010 | Sagues et al. | |
| 2003/0151695 | A1 | 8/2003 | Sahlin et al. | |
| 2006/0235637 | A1 | 10/2006 | Brayton et al. | |
| 2009/0222140 | A1 | 9/2009 | Christiansen | |
| 2009/0284889 | A1 | 11/2009 | Lenz | |
| 2011/0231176 | A1 | 9/2011 | Sagues | |

OTHER PUBLICATIONS

Extended European Search Report for Ep 11836970.1 issued Nov. 26, 2014.

* cited by examiner

CONFIGURABLE SOLENOID ACTUATION METHOD AND APPARATUS

RELATED APPLICATIONS

This application claims the benefit of U.S. Provisional Patent Application Ser. No. 61/406,414 filed Oct. 25, 2010, and is a continuation-in-part of U.S. patent application Ser. No. 13/069,292 filed Mar. 22, 2011 now U.S. Pat. No. 8,862,452 (which claims the benefit of U.S. Provisional Patent Application Ser. No. 61/316,070 filed Mar. 22, 2010), which is a continuation-in-part of U.S. patent application Ser. No. 12/911,445 filed Oct. 25, 2010 (now abandoned), which is a continuation of U.S. patent application Ser. No. 12/106,968 filed Apr. 21, 2008 (now U.S. Pat. No. 7,822,896 and which claims the benefit of U.S. Provisional Application Ser. No. 60/950,040 filed Jul. 16, 2007), which is a continuation-in-part of U.S. patent application Ser. No. 11/801,127 filed May 7, 2007 (now abandoned), which is a continuation of U.S. patent application Ser. No. 11/296,134 filed Dec. 6, 2005 (now U.S. Pat. No. 7,216,191), which is a continuation-in-part of U.S. patent application Ser. No. 11/043,296 filed Jan. 25, 2005 (now abandoned), which is a continuation-in-part of U.S. patent application Ser. No. 10/071,870 filed Feb. 8, 2002 (now U.S. Pat. No. 6,892,265 and which claims the benefit of U.S. Provisional Application Ser. No. 60/269,129 filed Feb. 14, 2001). The foregoing disclosures are incorporated herein by reference.

FIELD OF THE INVENTION

The present invention relates generally to methods and apparatus for driving solenoids, and more particularly to a configurable connectorized apparatus for driving a solenoid coil.

BACKGROUND

Solenoids are widely used throughout the world. Thus solenoids actuate relays or contactors that apply power to the starter motor of most cars. Solenoids actuate the lock mechanism in most keyless door systems. Most automatic valves, whether pneumatic or fluidic, employ solenoids to actuate or pilot the valve. Solenoids are found in factories, buildings, cars and homes.

FIG. 1 depicts a generic solenoid 10 showing its principal constituent parts. The two leadwires, 2, convey electrical current to the solenoid coil 3 which generates a magnetic field. The magnetic circuit of said solenoid 10 includes the metal case 4 and the air gap 6. The armature 5 is influenced by the magnetic field and a force will attempt to move or hold the armature 5 in the direction of the hardstop 8. When said armature 5 contacts and remains in contact with said hardstop 8, it is said to be sealed. Various features are often added to said armature 5 such as the hole 7 in order to attach a mechanism to the armature 5 and thereby complete the mechanical linkage to the solenoid mechanism. Not shown is the return mechanism, such as a spring, which tends to return said solenoid 10 to its open position when electrical current is removed from said solenoid 10.

Solenoids transduce the flow of electrical current into motion via force on the moving portion of the solenoid called the armature. The armature of a solenoid may be connected to various mechanisms, thus in a relay, the armature motion opens or closes electrical contacts whereas in a solenoid-operated valve, the armature is often directly connected to one side of a valve seal. In larger valves, the solenoid operates a smaller so-called pilot valve that employs some fluidic or pneumatic amplification, but the basic operation of the valve is initiated by the solenoid action.

Therefore, solenoids are essential components in a wide range of mechanisms that perform among other things, electrical switching, latching, braking, clamping, valving, diverting or connecting.

The most common method of actuating solenoids involves applying a constant voltage to the coil, whether AC or DC. The voltage causes a current to flow in the coil and a consequent magnetic field is generated which puts force on the solenoid armature and moves the mechanism to which the solenoid is attached. However, as described in detail below, there are significant challenges associated with driving solenoids in an energy efficient manner with circuitry that does not itself create further problems.

FIGS. 2-4 provide examples of circuits used for driving solenoids. FIG. 2 depicts a common prior art transistor solenoid drive circuit including transistor 11 which is capable of conducting electrical current in response to a signal on its input. Said electrical current will flow through solenoid 10. When said transistor 11 is caused to stop conducting in response to a signal on its input, a flyback diode 14 conducts electrical current in order to prevent the inductive component of said solenoid 10 from increasing the voltage seen by said transistor 11 and possibly destroying said transistor 11. When the energy in said solenoid 10 has been exhausted by the recirculation process, said current ceases and said solenoid 10 is thus de-energized.

FIG. 3 depicts a solenoid driver integrated circuit 12 such as is commercially available from a number of manufacturers and employing pulse width modulation (PWM) of the supply voltage in order to reduce the holding current to the solenoid 10. Connected to said solenoid driver 12 is said solenoid 10 as well as two of the commonly required external components, a flyback diode 14 and a series-connected diode 13 intended to both prevent damage to said driver integrated circuit 12 and to somewhat reduce electrical radiation from the PWM switching transients. Said solenoid driver integrated circuit 12 is fixed configuration and cannot be reconfigured for other purposes such as measuring or producing voltages or currents other than required for the narrow solenoid drive task at hand.

FIG. 4 depicts a typical prior art fixed configuration sinking output module 17 capable of driving solenoid 10. As is typical for the prior art, said output module 17 does not provide power to drive said solenoid 10 but instead relies upon connecting and disconnecting power provided by external device power supply 18. In addition, as is customary for said fixed-configuration output modules 17, terminal blocks 19 are employed to effect the wiring to said solenoid 10. In addition, as is customary for said output modules, a protective flyback diode 14 is installed to reduce voltages produced by said solenoid 10 during the de-energization process.

As is widely known to those skilled in the art of solenoid-driven mechanism design, there is a delicate balance between providing sufficient solenoid force at a desired distance of travel and generating excessive energy consumption and heating in the solenoid coil. The amount of electrical current required to move the solenoid to its closed position is high compared to the electrical current required to keep the solenoid closed—or sealed as is the term of art. Thus a solenoid that is to remain sealed for a long period of time tends to become hot and consume a large amount of energy compared to what is needed just to hold the solenoid sealed. The delicate balance for the solenoid-driven mechanism designer is to build a solenoid that will reliably move a given distance to the sealed position while at the same time not consuming excessive electrical power or overheating despite constant application of power to the solenoid coil.

This basic design challenge of the solenoid underscores the problem that is to be solved by this invention, and therefore a more detailed description of the cause of this design challenge is justified in order to explain the merits of this invention.

Whereas the solenoid transduces the flow of electrical current to force on the armature, said force is not a constant function of electrical current. When the solenoid is sealed, there is essentially no air gap in the magnetic circuit, thus the magnetic flux is relatively high at a given electrical current. However, when the solenoid is fully open, there exists an air gap in the magnetic circuit that significantly increases the electrical reluctance of the circuit, said reluctance being the ratio of magnetomotive force (MMF) to magnetic flux developed. Thus at said given electrical current, the force on the fully open armature can be significantly lower than when the armature is in the sealed position. In order to move the armature reliably, therefore, it is necessary to supply more electrical current than is required when the solenoid is sealed. To make matters worse, the requirement for high current to seal the solenoid only lasts for a fraction of a second whereas the solenoid is often left in its conducting, sealed state indefinitely. Energy is being wasted.

Those skilled in the art long ago realized that, for a given solenoid current, the force on the armature increases as the armature moves closer to its sealed or closed position because reluctance decreases with the shorter air gap. These same persons reasoned that by varying the current or voltage to the solenoid, they could provide an initially higher force to seal the solenoid and subsequently reduce the current or voltage in order to hold the solenoid sealed because the force exerted upon a sealed solenoid armature is much higher than the force on an open solenoid given the same electrical current or voltage. By employing this strategy of varying the current or voltage, it is possible to reduce the heating of the solenoid coil while providing the required high force to close the solenoid.

In U.S. Pat. No. 7,262,950 B2 ("Suzuki"), Suzuki teaches that building a current control circuit can allow cutting back the current to the relay coil after the relay has closed. Unfortunately, the circuit of Suzuki requires that a series-wired transistor throttle the current to the relay coil thus creating heat and reducing the possible energy savings considerably. Thus Suzuki's invention does somewhat reduce solenoid heating but by moving some of the heat generation to a transistor. For example, if Suzuki reduced the holding solenoid current to ½ of the initial pull-in current, then the system of Suzuki would see solenoid energy use go down to ¼ of the previous level. Unfortunately, another ¼ of said energy is burned up in ohmic losses in the transistor. In addition, Suzuki does not mention a strategy for dealing with the effect of the relay coil inductance during relay turn-off. It is well understood in the art that employing a transistor to remove power from an inductor will result in a large voltage swing that in general must be mitigated by inserting a path for current to flow thus avoiding a dangerous increase in circuit voltage. Generally, a diode is employed that will allow the relay coil current to circulate during turn-off.

Others have attempted to avoid wasting half of the energy reduction. Others have reasoned that employing pulse width modulation (PWM) of the solenoid voltage could reduce the losses in the transistor via well-understood power switching technology in which the transistor is rapidly turned on and off, largely avoiding its linear region. This strategy works well for inductive circuits wherein little current initially flows during the closing of the transistor. Fortunately, a solenoid is highly inductive, thus PWM works well. Unfortunately, however, PWM can easily generate disruptive electrical radiation unless special care is taken. In an industrial control system application it is almost unthinkable to place restrictions on the user of a solenoid.

Then too, a class of integrated circuits, such as Texas Instruments DRV102 PWM Valve/Solenoid Driver, has aimed to produce a fixed and dedicated electrical circuit capable of initially driving the solenoid with full voltage and consequently full current and subsequently reducing said current by performing PWM of the power signal to the solenoid. Unfortunately, said integrated circuits can produce undesirable electrical interference as described earlier. For example, an application note for the Texas Instruments DRV102 states, "The PWM switching voltages and currents can cause electromagnetic radiation." The note further suggests that determining the location of noise reducing components "may defy logic", i.e. may be difficult to predict and require repetitive empirical testing. In addition, such integrated circuits usually require the addition of a number of external components and are fixed configuration: the connector to which the solenoid is attached can only drive a solenoid. The present invention as explained below provides additional applications and flexibility that is not available using these prior art devices.

The prior art has not adequately addressed a significant design challenge in solenoid driving: how to determine if a solenoid is sealed. A solenoid can fail to reach or stay at its closed or sealed position upon the application of electrical current for a number of reasons. The solenoid may be jammed and unable to initially move in either direction. The solenoid coil may be open or not electrically continuous and therefore incapable of generating the required magnetic field. The solenoid coil may be shorted. The solenoid may be exposed to vibration that puts a sufficient force on the solenoid to unseal it. Or, there could be a momentary loss of electrical current that results in the solenoid holding force being reduced briefly. Or, the current applied to the solenoid coil might be slightly less than required to reliably hold the solenoid armature sealed under all physical variations such as ambient temperature. The prior art only teaches a single solution to this dilemma of determining the solenoid state, and that is to cause the solenoid to close an electrical connection when it is sealed. FIG. 5 depicts the prior art apparatus for determining the state of the solenoid, whether sealed or open. In this prior art system, the controller 90 commands a solenoid coil 91 to close. After the solenoid 91 has been given sufficient time to seal, the controller 90 then senses the state of the auxiliary contact 92 which is mechanically linked to the solenoid mechanism. Based upon the state of said auxiliary contact 92, said controller 90 can deduce the state of the solenoid 91. However, if the solenoid 10 is not a relay, then said solenoid 10 must be mechanically connected to said auxiliary contact 92, such connection being problematic and costly. Even in the case where the solenoid is part of a relay, this strategy requires using one set of contacts for this monitoring process. Additional electrical circuits are required to monitor this extra contact, and for systems employing reduced holding current, the actuation sequence must be repeated. In the case where the solenoid is not a part of a relay, then a set of contacts must be added to the solenoid mechanism. This requirement is prohibitive except for the most critical solenoid systems.

SUMMARY OF THE INVENTION

The present invention provides a configurable connectorized method and apparatus for driving a solenoid coil, capable of providing a sufficiently high force to move the solenoid from its fully open position to its sealed position. It can also reduce the energy consumed and the heating of the solenoid coil when the solenoid is sealed. The present invention reduces the energy without continuous losses from a series throttling transistor or resistor. The invention facilitates detection of a solenoid coil which is open or shorted, and can reduce the current on a solenoid for which the armature is jammed in order to reduce the consequential overheating of the coil. The present invention eliminates the requirement to use PWM as the drive method, and handles coil turn-off behavior without the need for additional components such as diodes. The present invention simplifies connections to one or more relays or solenoids without the requirement for external power supplies. The present invention allows determination of whether a solenoid is sealed without the need for auxiliary electrical contacts, and can use information about the solenoid unsealed state to essentially instantaneously increase the force on the solenoid armature to cause the armature to return to its sealed position before the armature has moved significantly.

The present invention extends the teachings of U.S. Pat. Nos. 6,892,265, 7,216,191 and 7,822,896 and U.S. patent application Ser. No. 13/069,292, published as Patent Appl. Publ. No. US 2011/0231176. In the previous inventions, a configurable connectorized system is described in which any connector pin of such a system may be configured for a wide variety of electrical functions, such as measuring a voltage, producing a voltage, measuring a current, producing a current, producing various power levels or even handling frequency information such as serial communication data.

A single version product built using these teachings has solved numerous industrial controls problems. When compared with traditional industrial control input/output modules, the configurable, connectorized input/output module dramatically reduces the number of additional components required such as power supplies and terminal blocks. The configurable, connectorized input/output system eliminates the need for many different fixed-configuration modules by virtue of its ability to change the electrical configuration of its connector pins.

The present invention enables the pin configuration of the input/output module to be changed during normal operation, thus if a solenoid is connected between two such pins, the voltage across the solenoid may be changed without any added components or without the required use of PWM. Because the present invention enables the pin configuration to be changed from one power supply to another or varying the voltage level of any said multiple power supplies, the invention allows high efficiency power supplies to be used. Therefore, no throttling or PWM is required to reduce the voltage across the solenoid, although nothing precludes the use of PWM in the present invention should it, for some reason, be determined to be beneficial. In addition, the present invention also provides two ways to handle the inductive current at turn-off. First, the configurable connectorized module can throttle the current gradually while holding the coil voltage within an acceptable level. Second, the first of one of the solenoid's two pins may be again reconfigured to the same voltage as the second pin thus connecting both sides of the solenoid coil to the same power supply, either high side or low side. In both ways, the effect of the inductance of the coil during circuit turnoff is addressed, and no additional components are required to provide for safe circuit operation.

In addition, because the present invention provides for connecting other sensing and sourcing circuit elements to the connector pin, it is possible to determine whether the solenoid is sealed. Said determination is based upon the fact that the electrical inductance of the solenoid is inversely related to the electrical reluctance and said reluctance decreases as the solenoid air gap goes to zero. Said determination is achieved by imposing either a periodic or step change to voltage across the solenoid and measuring the resulting periodic or step change in current. Said resulting current is a function of solenoid inductance. Or, alternatively, said determination may be achieved by making either a step change or a periodic change to the current through the solenoid and measuring the resulting change in voltage, although the preferred embodiment is the former method of determination. Said determination includes whether the solenoid is sealed, opening or open. In addition, in the case where the solenoid becomes unintentionally unsealed, the method and apparatus of the present invention is capable of essentially simultaneously increasing the solenoid current to reseal the solenoid, thus preventing unintended opening of the solenoid. Said resealing can be effected without any additional apparatus than is found in the present invention.

DETAILED DESCRIPTION OF THE INVENTION

Figure 1:
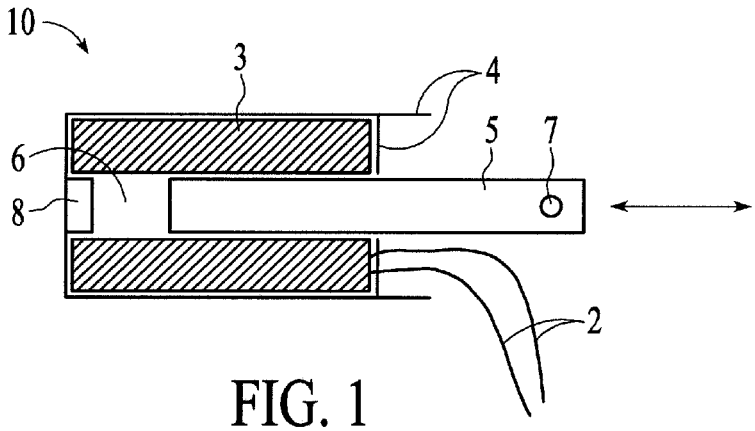
FIG. 1 (PRIOR ART)
FIG. 1 is a depiction of a generic solenoid showing its principal constituent parts.
Figure 2:
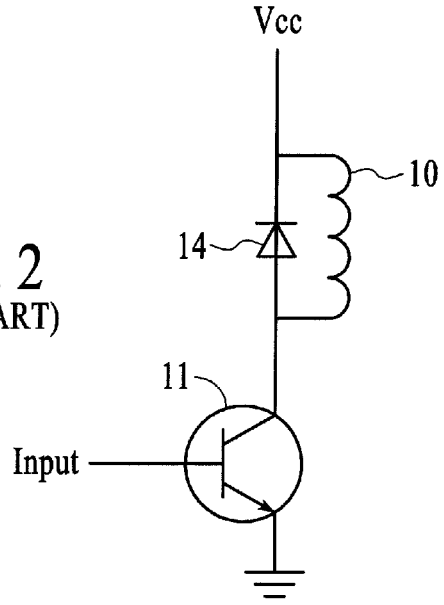
FIG. 2 (PRIOR ART)
FIG. 2 is a common prior art circuit apparatus for driving a solenoid coil, and in particular shows the required fly-back diode.
Figure 3:
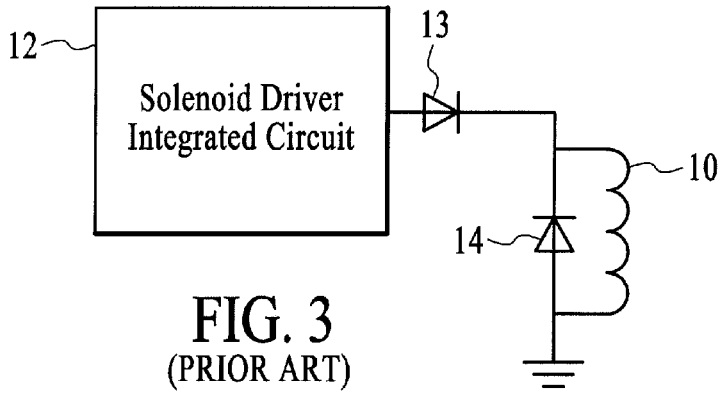
FIG. 3 (PRIOR ART)
FIG. 3 is a common prior art circuit apparatus for driving a solenoid coil that uses pulse width modulation (PWM) and in particular shows the required series-wired diode as well as the additional fly-back diode.
Figure 4:
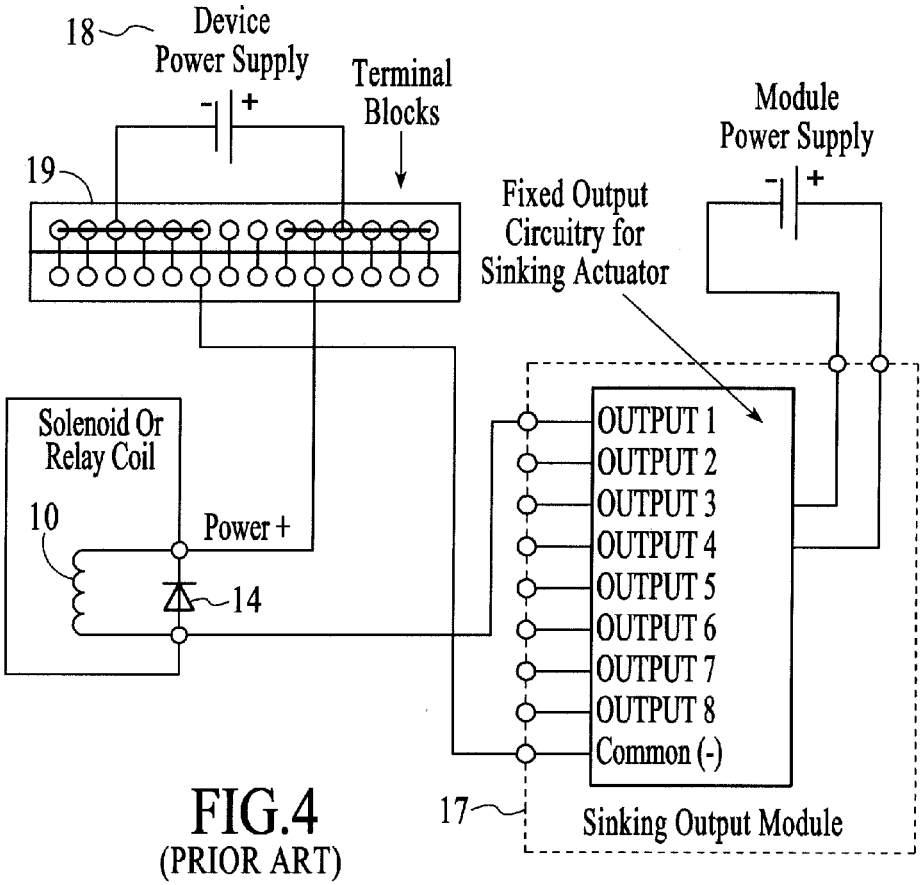
FIG.4 (PRIOR ART)
FIG. 4 depicts a prior art circuit common to a programmable logic controller or industrial fixed-configuration output module.
Figure 5:
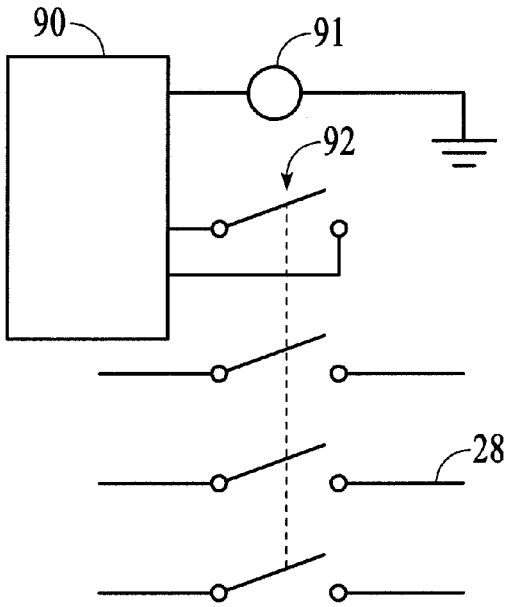
FIG. 5 (PRIOR ART)
FIG. 5 depicts the prior art apparatus for detecting the unsealed state of a solenoid.
Figure 6:
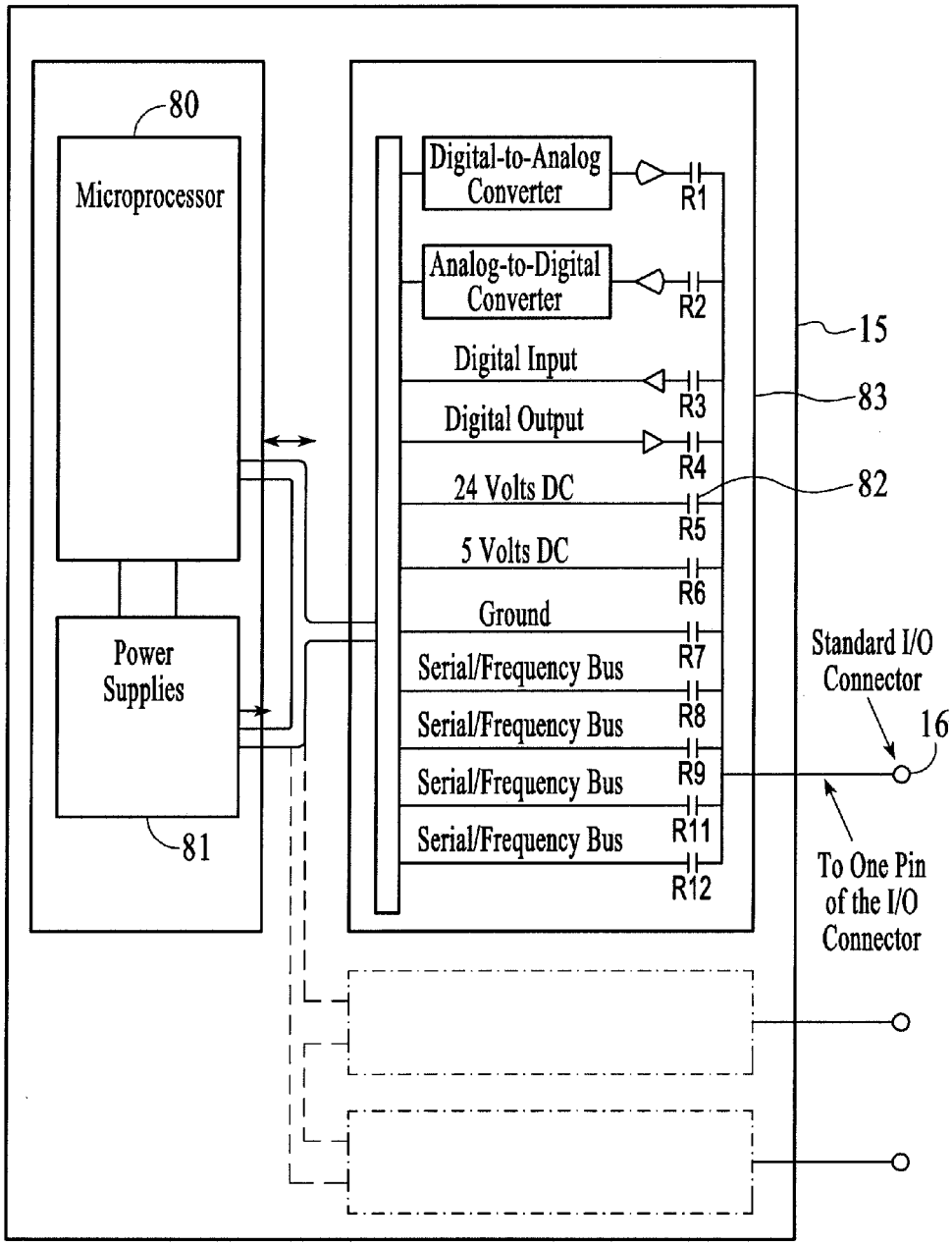
FIG. 6 depicts the configurable apparatus of the present invention.

FIG. 6 depicts a functional block diagram of the configurable connectorized input/output module 15 of the present invention. Included inside said module 15 of the preferred embodiment is a microprocessor 80 which is capable of directing any of a plurality of signals to one or more pins 16 which are subsequently to be connected to various sensors and actuators such as solenoid, but by no means limited to solenoids. In particular, said configurable connectorized input/output module 15 contains one or more power supplies 81 which may be routed in the same manner as other of the plurality of signals via switching means 82 such as R5 or R6 and connect to one or more connector pins 16. When a solenoid is connected between two such pins 16, the configurable connectorized input/output module 15 can produce one of a plurality of power levels to said solenoid thereby adjusting the current flowing through the solenoid without the need for PWM.

The configurable input/output module 15 may contain any number of interconnection apparatus 83. Each interconnection apparatus 83 is connected to one device connector 16 and optionally through an internal cross point switch to another interconnection apparatus. (See FIG. 13 and related description.) FIG. 6 is highly stylized and is intended to convey the essence of the module of the present invention.

Figure 7:
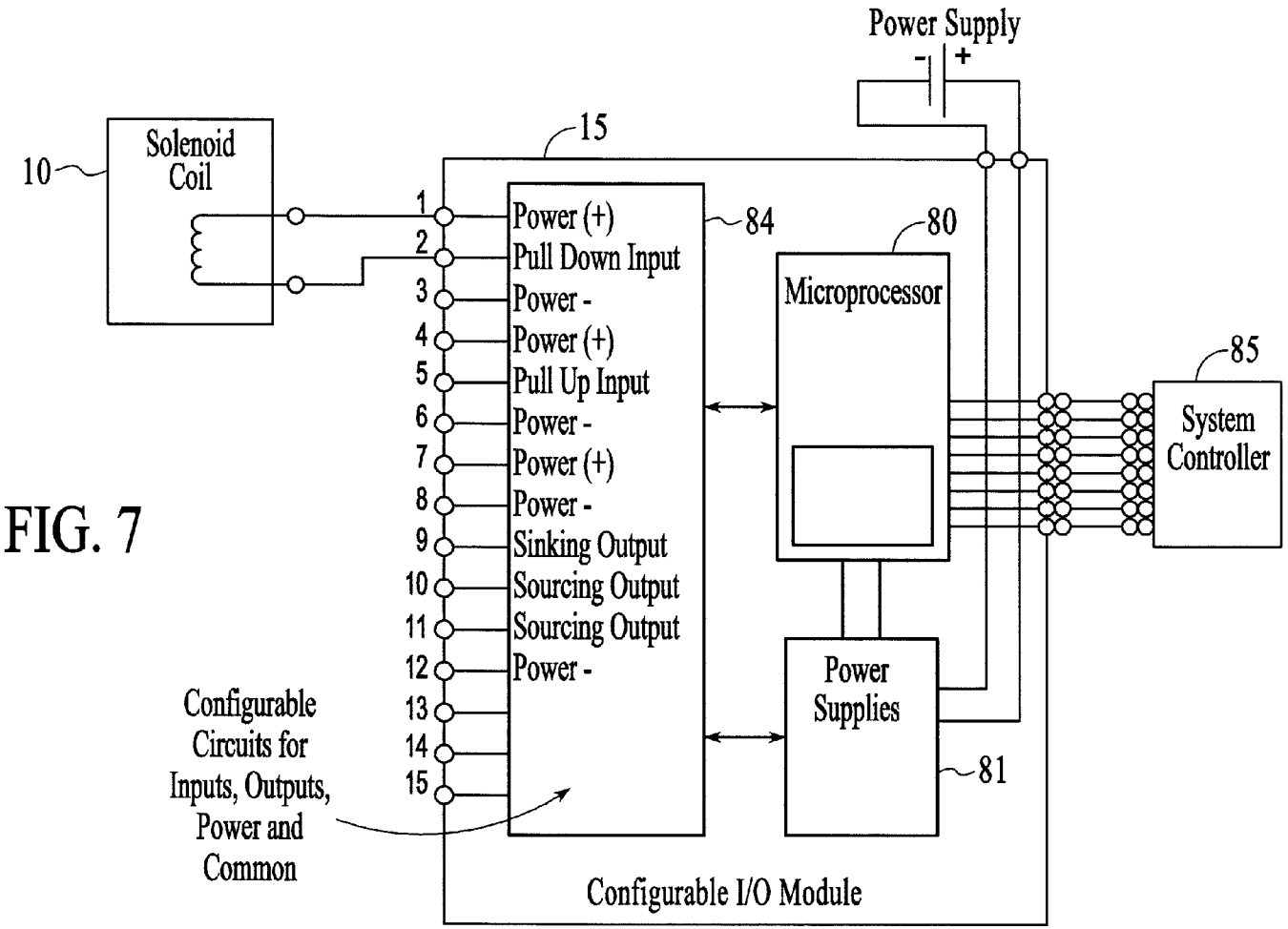
FIG. 7 depicts the connection of a relay or solenoid coil to a configurable connectorized module of the present invention.

FIG. 7 depicts the configurable connectorized input/output module 15 of the present invention when connected to a solenoid 10. In this configuration, said module 15 has been configured by the microprocessor 80 to route a plurality of power levels from power supplies 81 to pins 1 and 2 of said module 15. Any of the 15 pins shown in FIG. 7 could have been configured for this function, unlike prior art fixed-configuration output modules. Unlike the prior art fixed-configuration output module, where an external device power supply was required, none is required by the present invention and none is shown in FIG. 7. Also unlike the prior art fixed-configuration output module where a flyback diode is required to protect the output module, none is required by the present invention and thus none is shown. The configurable connectorized input/output module 15 of the present invention is thus able to cause one of a plurality of voltages to be applied to the connected solenoid 10 thus effecting the goals of the present invention.

Figure 8A:
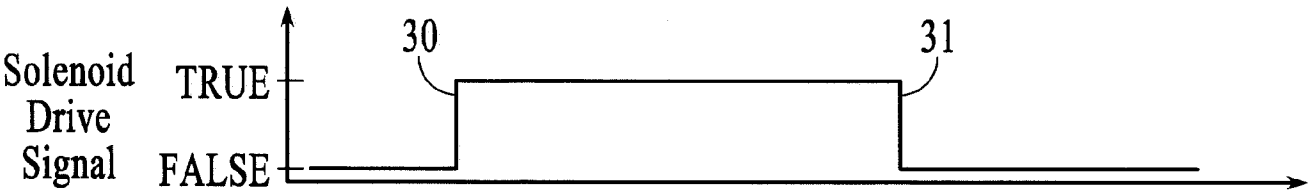
FIGS. 8A, 8B and 8C depict the command, voltage and current wave forms, respectively, of the present invention when actively snubbing the decaying solenoid currents to zero.
Figure 8B:
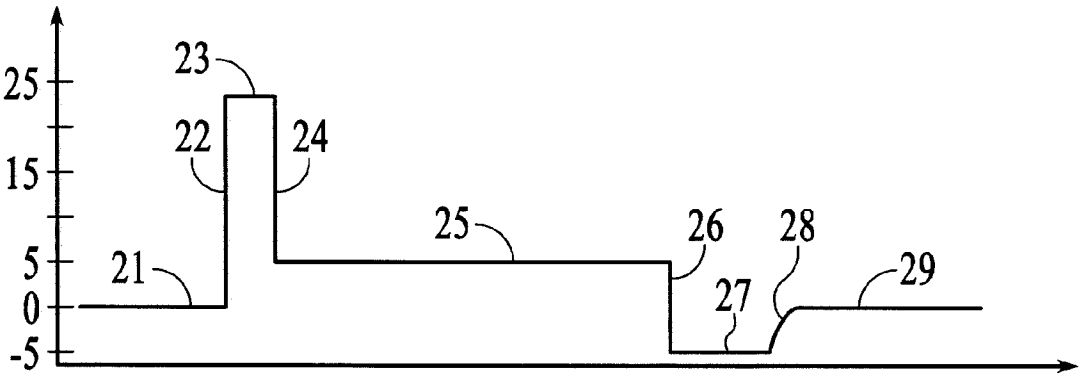
Figure 8C:
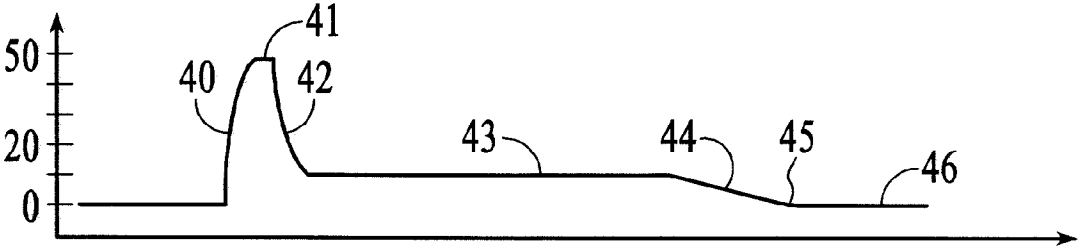

FIGS. 8A, 8B and 8C depict the voltage and current waveforms resulting from the actuation of the solenoid 10 using a snubbing turnoff method and apparatus, and shown as Solenoid Drive Signal in FIG. 8A. There are nine phases to the voltage waveform which we will now describe. Each phase is numbered 21 through 29 in FIG. 8B.

In Phase 21, the solenoid voltage is zero which is the idle state of the solenoid. The solenoid is unpowered and ready to be actuated.

In Phase 22, in response to the solenoid drive signal becoming true, 30, the configurable connectorized input/output module 15 connects the actuation-level voltage to the solenoid 10. In this preferred embodiment, said activation-level voltage is 24V. In response to the imposed voltage, current in the solenoid coil rapidly increases, 40, and the solenoid moves smartly because the imposed voltage is preferably higher than the sustainable steady state coil voltage. However by varying the duration of phase 23, it is possible to control the solenoid actuation force.

In Phase 23, the configurable connectorized input/output module 15 maintains the pull-in-level voltage on the solenoid coil and the coil current moves asymptotically to steady state, 41. The length of the Phase 23 portion is sized such that said solenoid current may not reach steady state in order to control the solenoid actuation force. At the end of phase 41, the solenoid is preferentially in its closed or sealed position.

In Phase 24, the configurable connectorized input/output module 15 essentially simultaneously disconnects the actuation-level voltage from the solenoid and connects the sustain-level voltage to the solenoid. Alternatively, the voltage level of a single power supply can be varied to achieve the same goal. The sustain-level voltage is chosen to provide ample holding force for the solenoid, whereas said sustain-level voltage might not be sufficient to reliably pull in the solenoid under all conditions. Said sustain-level voltage can preferentially be adjusted by the microprocessor 80. As Phase 24 begins, the solenoid coil current 42 begins to decrease in response to the lower applied voltage. Said solenoid coil current decreases to a steady state 43 after some time period which is a function of the solenoid electrical characteristics.

In Phase 25, the sustain-level voltage is maintained on the solenoid in order to keep the solenoid sealed. Phase 25 is maintained as long as required by the control system. This time can range from milliseconds to months or longer.

In Phase 26, the process is begun to remove power from the solenoid in response to the solenoid drive signal becoming false, 31. The configurable solenoid drive circuit cannot simply open its drive transistors to the solenoid because the inductance of the solenoid coil—which makes rapid reduction in current infeasible—would cause the voltage at the configurable connectorized input/output module pin 16 to become very negative with respect to ground and likely damage or destroy the switching means 82. If the solenoid coil is equipped with a so-called flyback diode, then said solenoid current is provided a path while the coil energy is dissipated. If, however, there is no flyback diode, then the coil voltage will cross zero volts and become negative. The configurable connectorized input/output module 15 of the present invention is therefore configured to begin to throttle the coil current and clamp the coil voltage to a value, which in the preferred embodiment is approximately −5V with respect to ground.

In Phase 27, the throttling process continues until the voltage that the coil is capable of sourcing falls to less than the clamped voltage. During Phase 27, the solenoid coil current 44 decreases linearly.

In Phase 28, the configurable connectorized input/output module 15 stops actively throttling the solenoid coil current and instead provides a fixed transistor gate drive thus dissipating the remaining energy from the solenoid coil. The solenoid current, 45, decays exponentially to zero during Phase 28, and the solenoid coil returns to its idle state.

In Phase 29, the solenoid coil is in the same state as it was in Phase 21: the coil is quiescent, the solenoid is not engaged and the solenoid is again ready to be actuated. The solenoid coil current, 46, is also zero.

With reference to FIGS. 6 & 7, the interface apparatus 84 may be configured to connect one of a plurality of power supplies to the device connector 16 to which the solenoid 10 is connected. For example, switching means 82 can initially be caused to connect a 24VDC power supply to said device connector 16 in order to achieve the solenoid pull-in phase. Likewise, said interface apparatus 84 may then be caused to connect a 5VDC power supply to said device connector 16 in order to achieve the solenoid sustaining phase.

Figure 9A:
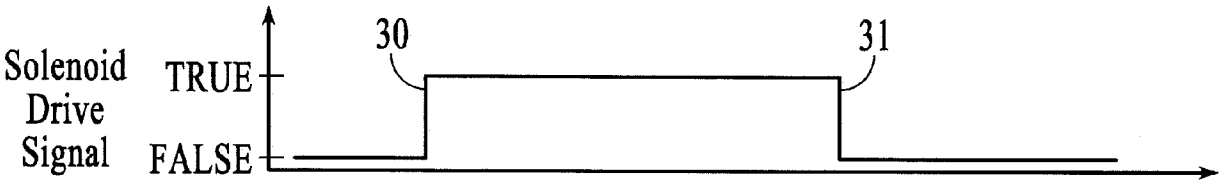
FIGS. 9A, 9B and 9C depict the command, voltage and current wave forms, respectively, of the present invention when allowing decaying solenoid currents to flow to zero.
Figure 9B:
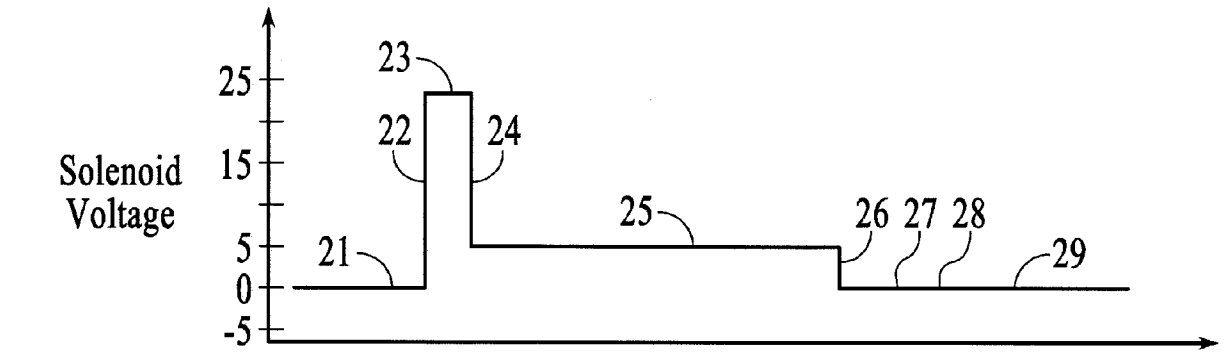
Figure 9C:
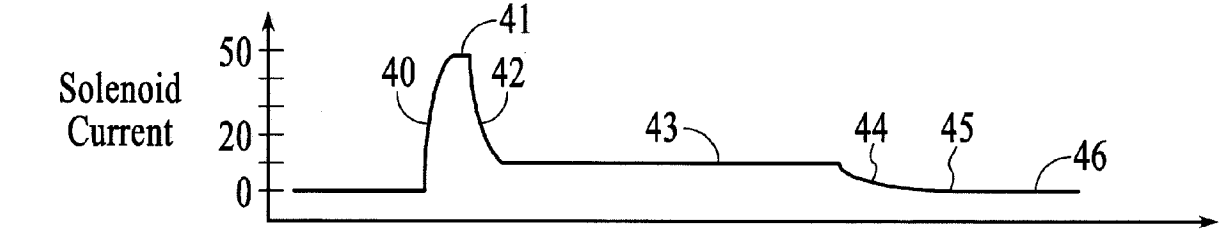

FIGS. 9A, 9B and 9C are very similar to FIGS. 8A, 8B and 8C with the exception that rather than throttling the solenoid current, the two pins of the configurable connectorized input/output module 15 which are connected to the solenoid 10 are set to the same voltage, either high-side or low-side. In so doing, the solenoid current flows through said module 15 until the solenoid current is exhausted. Thus phase 27 in FIG.

9B remains at zero volts, not −5 volts as in FIG. 8B. And the current in FIG. 9C decreases asymptotically to zero in phase 46.

In the context of the present invention, determining the state of the solenoid, whether sealed, opening or fully open is achieved by measuring the inductance of the solenoid coil, since said inductance is inversely proportional to reluctance which is itself a function of the solenoid air gap: reluctance decreases as air gap decreases and then further decreases when the solenoid fully seals and the air gap is essentially eliminated. The present invention provides a number of methods and a number of apparatuses to measure said inductance. Two methods and two apparatuses will be described, but are intended to be for illustrative purposes only. Simpler or more appropriate methods using other features of the present invention are possible but this description is intended to convey the essence of the invention.

Figure 10:
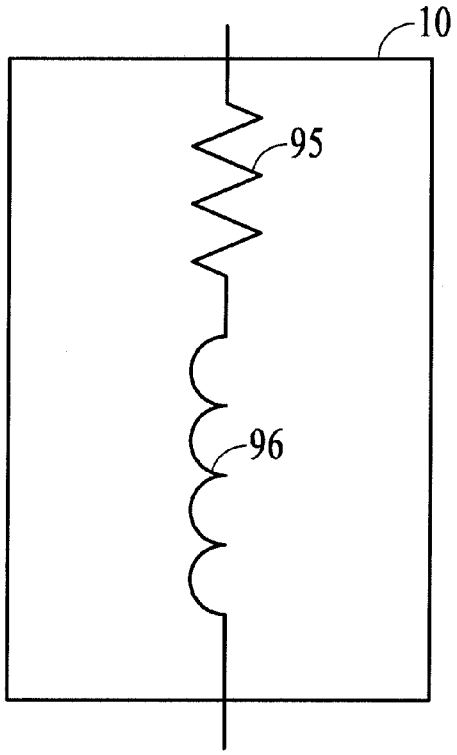
FIG. 10 depicts a model of the constituent resistive and inductive components of the solenoid for the purpose of describing the method and apparatus of the present invention for determining the unsealed state of a solenoid.

FIG. 10 depicts a common electrical circuit model used to describe the inductance measurement of the present invention. Specifically, the solenoid 10 has been broken down into two constituent parts. Its resistive component 95 is series-connected to its inductive component 96. This model will facilitate the description of the inductance measurement system.

Figures 11A, 11B, 11C, 11D:
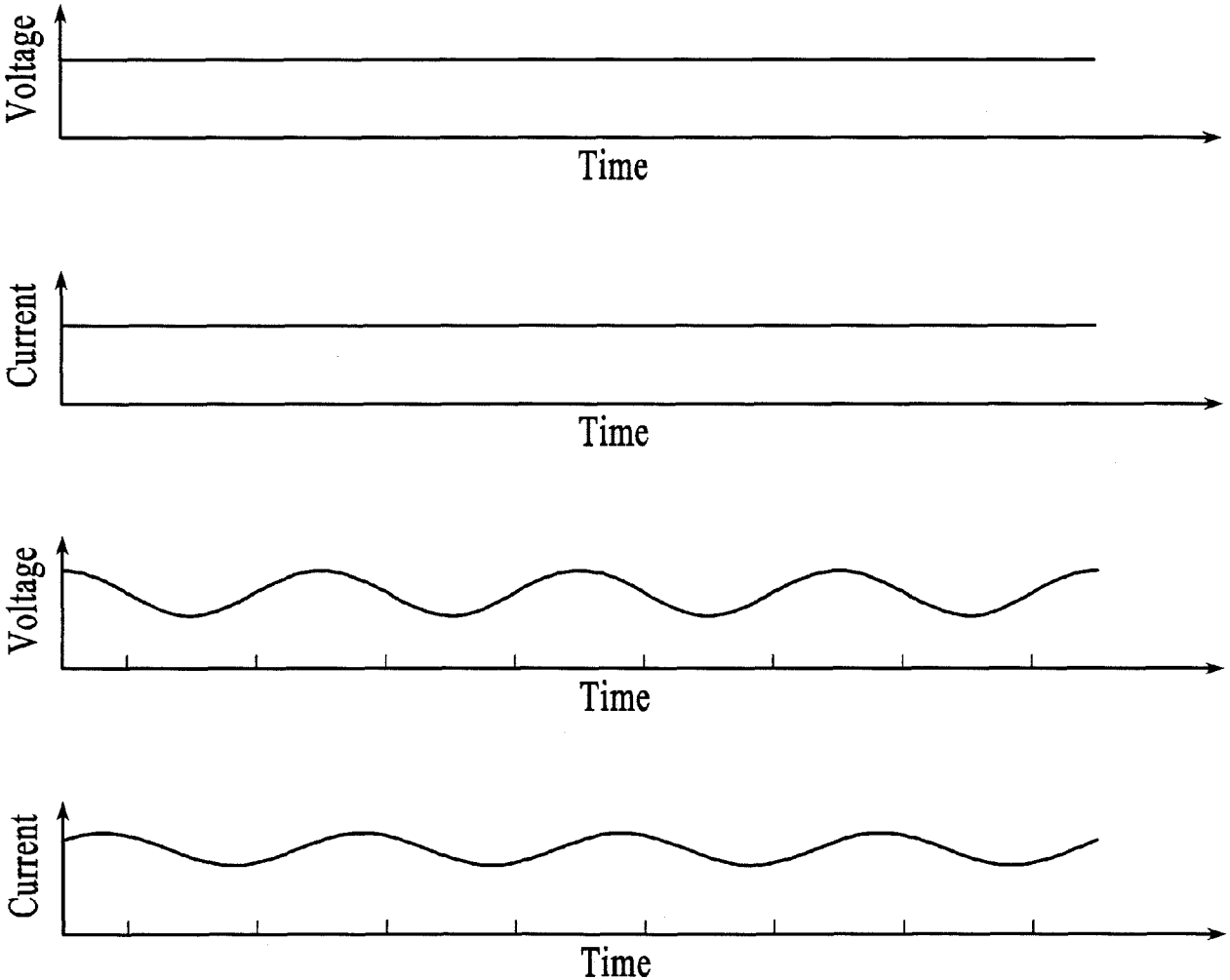
FIGS. 11A, 11B, 11C and 11D depict the voltage and current waveforms, employed to measure the inductance of the solenoid and thereby determine the unsealed state of said solenoid, of the present invention.

FIG. 11A depicts the DC voltage across a solenoid. Said voltage may be any appropriate value greater than or equal to zero volts. FIG. 11B depicts the resulting DC current given the applied voltage depicted in FIG. 11A, said resulting DC current being greater than or equal to zero. FIG. 11C depicts a sinusoidal voltage signal of suitable frequency imposed upon the DC voltage signal of FIG. 11A, said sinusoidal voltage being a sufficiently small percentage of the DC voltage as not to affect the operation of the solenoid but sufficiently large to generate a measurable current in said solenoid 10. Said sinusoidal voltage signal is established by making small changes to the voltage setpoint of any of the multiple power supplies 81 connected to the configurable connectorized input/output module 15 of the present invention. Said sinusoidal voltage signal will cause a variation in the DC current signal of FIG. 11B that is also essentially sinusoidal. Said variation in the DC current signal is shown in FIG. 11D. The phase of the signal of FIG. 11D with respect to the sinusoidal voltage signal of FIG. 11C will be a function of the relative magnitudes of the two constituent elements depicted in FIG. 10, the resistive 95 and inductive 96 components of said solenoid 10. Specifically, if the resistive element 95 of FIG. 10 were to be large and the inductive component 96 of FIG. 10 were to be small, then the phase of the current signal of FIG. 11D with respect to the voltage signal of FIG. 11C will be small and closer to 0 degrees than 90 degrees. If, however, the resistive component 95 of FIG. 10 were to be small and the inductive component 96 of FIG. 10 were to be large, then the phase of the current signal of FIG. 11D with respect to the voltage signal of FIG. 11C will be large and closer to 90 degrees than 0 degrees. Using well known methods of signal processing wherein quadrature components of the current signal can be extracted, we can measure the inductive component of the solenoid 10.

Alternative methods and apparatuses may be used for the inductance measurements, such as periodic square wave excitation rather than periodic sine wave excitation with similar results and perhaps a simpler and more effective embodiment. Furthermore, step changes in voltage or current and the subsequent measurement of the response in current or voltage can provide similar inductance measurements in an embodiment that may be more appropriate for the electronic circuits employed.

Figure 12A:
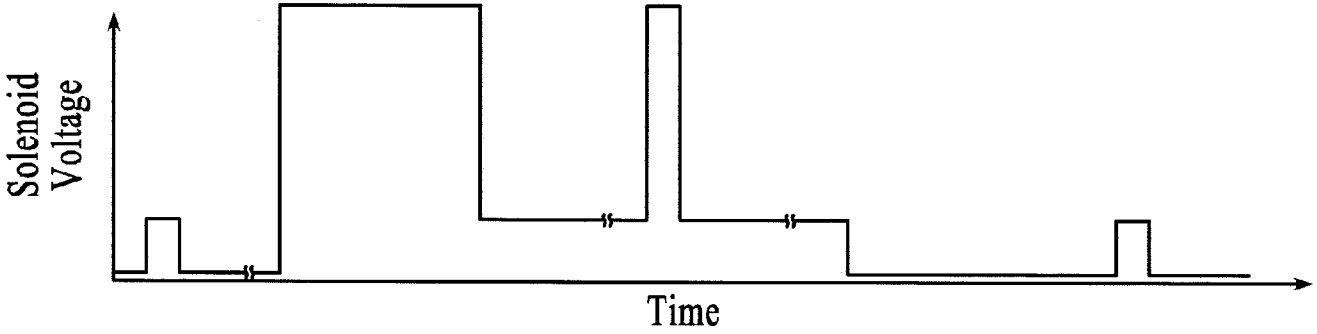
FIGS. 12A and 12B depict voltage and current waveforms for an alternative method of the present invention for solenoid state determination.
Figure 12B:
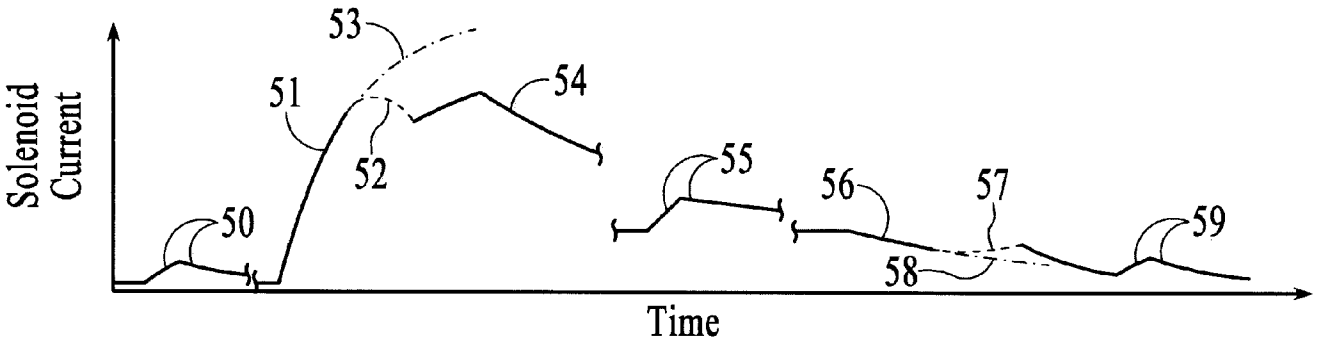

An alternative method for solenoid state determination relies upon observation of step responses rather than the phase and magnitude of response to periodic excitation. FIG. 12A depicts solenoid voltage for a typical energization and de-energization sequence, with state query pulses used to determine whether the solenoid is sealed. The magnitude or polarity, and the duration of these query pulses are designed to avoid altering the state of the solenoid. FIG. 12B depicts the solenoid current response to this sequence in FIG. 12A and its query pulses. The three voltages imposed across the relay in this method would, in a preferred embodiment, be the same levels used for energization, holding, and de-energization, although this is not a critical aspect of the present invention. This method will now be described in detail, in the order of events or phases in the depicted sequence.

Initially, the solenoid is de-energized, with zero current and voltage. In that state, query pulses of sufficiently small amplitude and duration can be applied to produce the current response 50 without moving the solenoid armature. By sampling said current response at its known peak, at the end of the query pulse, the solenoid inductance can be inferred with one sample provided the query pulse duration is short in comparison to the L/R time-constant of the solenoid in its sealed or unsealed state, or in between states. As described previously, this inductance indicates the solenoid state, an object of the invention.

At some time, the solenoid is energized, producing the current response 51 and one of the current responses 52 or 53, depending upon whether the solenoid armature moves or not. Because the inductance can be measured for the de-energized state, and because responses 51 and 53 are both part of a simple, real exponential determined by that known inductance and the resistance known by other means, this non-moving pin response can be readily distinguished from the response pair 51 and 52 which exhibit markedly different trajectories. This distinction may be made by sampling the current at times along the response whose time-separation is short in comparison to the L/R time-constant, permitting a simple computation by microprocessor 80 to detect the trajectory departure 52 from the simple, real exponential, which departure indicates the desired motion of the solenoid armature. This method represents an improvement over an earlier invention, U.S. Pat. No. 3,946,285, which relies upon detection of the cusp at the end of response phase 52, because it does not rely upon double differentiation or existence of the cusp which can be softened or eliminated if the solenoid armature is not abruptly stopped at the end of its energization travel.

After successful energization, the solenoid voltage is reduced to its holding level, producing current response 54, eventually settling to the low-power holding current at the onset of current response 55.

During energization, query pulses are applied at whatever rate is appropriate for the application, producing current response 55. While this is similar to current response 50, the current change relative to the step amplitude is smaller because of the much higher inductance of the solenoid in its sealed state. Again, as for current response 50, a single sample at the response 55 peak can be used to infer solenoid inductance and hence its sealed or unsealed state. Because the inductance in the unsealed state is several times smaller than the sealed state inductance, the amplitude of the current response 55, relative to its holding current baseline, readily distinguishes the solenoid states.

At some time, the solenoid is de-energized, producing the current response 56 and one of the current responses 57 or 58, depending upon whether the solenoid armature moves or not.

These conditions can be distinguished by the same criteria mentioned above for detection of successful energization, except to detect successful de-energization.

Finally, the de-energized starting state is reached, with query pulses producing current response 59 at whatever rate is appropriate for the application.

It should be noted that the query pulses indicate the solenoid armature position independently of whether armature motion is detected by distinguishing current trajectories. For many applications, the query pulses alone would suffice to detect solenoid failures. However, the motion detection provides an earlier indication of success or failure, during a time when the query pulses cannot be applied. Such earlier detection may be important in applications where other system actions should soon follow a solenoid state change, but only if that change occurs as commanded.

Said measurement of inductance can be pei formed constantly by the configurable, connectorized system of the present invention. Because the measurement does not affect operation of the solenoid, it is preferable that the measurement be first made when the solenoid is not energized with a DC voltage above zero. Said first measurement is then used as the baseline inductance of the solenoid.

While the solenoid is first commanded to seal by the action of the configurable connectorized input/output module 15, said measurement of inductance continues to be made. When the solenoid is sealed, the sealed measured inductance will be higher than said first baseline measurement of inductance because of the previously described electrical characteristics of a solenoid. Said sealed measured inductance is stored by the microprocessor 80 of the configurable connectorized input/output module 15 and is subsequently used to determine the state of the solenoid, whether sealed, opening or open.

Said inductance measurement is continuously performed during the time that the solenoid is intended to remain sealed and during which time the solenoid voltage is at its lower holding level 25. If, for any reason, said solenoid 10 becomes unsealed, its inductance will consequently decrease. Said inductance measurement will detect this decrease in inductance. Essentially simultaneously, the configurable connectorized input/output module 15 will increase the solenoid voltage to its pull-in value 23 in order to reseal the solenoid 10. In so doing, the present invention can prevent the solenoid armature 5 from moving far enough to affect the mechanical state of the mechanism to which the solenoid 10 is connected. After the solenoid 10 is resealed, the configurable connectorized input/output module 15 may then again lower the applied solenoid voltage to the hold-in value 25 in order to again reduce the energy consumed by the solenoid 10. The method and apparatus of the present invention may optionally slightly increase the applied solenoid voltage to slightly increase the solenoid holding force to compensate for the effect that led to the unsealing of the solenoid.

The snubbing turnoff method as described with reference to FIGS. 8A-8C above, the variations described with reference to FIGS. 9A-9C, the method for determining the state of a solenoid as described with reference to FIGS. 10 and 11A-11D and variations thereof may all be implemented with the configurable, connectorized input/output module of the present invention and a computer program. The computer program may be stored in memory in the module and executed by the microprocessor in the module. Alternatively, the program may be stored externally to the module—in a control system for example—and instructions are sent to the microprocessor in the module for running the processes. In a further alternative, computer programs for some of the processes of the present invention may be stored in memory on the module, and some external to the module—in memory in the control system, for example. An example of a system controller 85 connected to the module 15 is shown in FIG. 7. The connection between the system controller and the module may be a standard cable or a network connection (for example, Ethernet). The connection may be a backplane connector—for example, the module may be plugged into the backplane of a PLC or an embedded controller. The connection may also be a wireless connection. Without departing from the teaching of the present invention, a configurable, connectorized input/output module may: act as a so-called embedded controller; be a circuit board which is part of a larger system; or function as the system controller by itself.

The interface apparatus 84, including interconnection apparatus 83 such as those illustrated in FIG. 6, may be configured as an integrated circuit (IC). The IC is repeated within the I/O module 15 for each device connector 16. Thus, if there are 25 device connectors 16, then 25 ICs would be employed. The module 15 can contain any number of ICs, just as any module may contain any number of device connectors 16. Another embodiment may employ a different IC architecture in which multiple device connectors 16 are handled in each IC or multiple ICs are used to handle one or more device connectors. The result of using an IC is a dramatic reduction in the size and cost of building a module 15 by virtue of the miniaturization afforded by modern semiconductor processes.

Figure 13A:
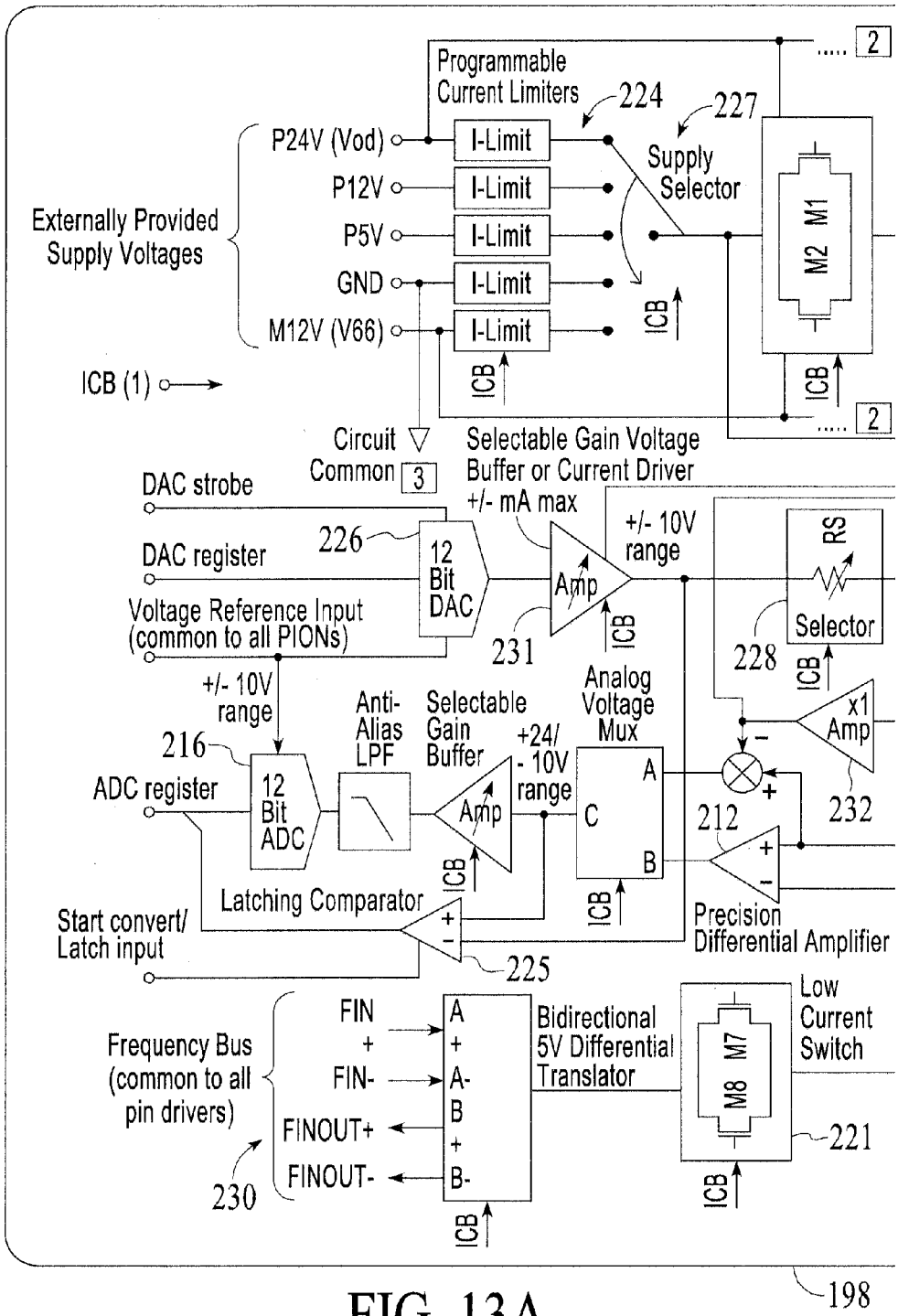
FIG. 13 is an example of an ASIC configured as a pin driver interface apparatus, according to some embodiments of the present invention.
Figure 13B:
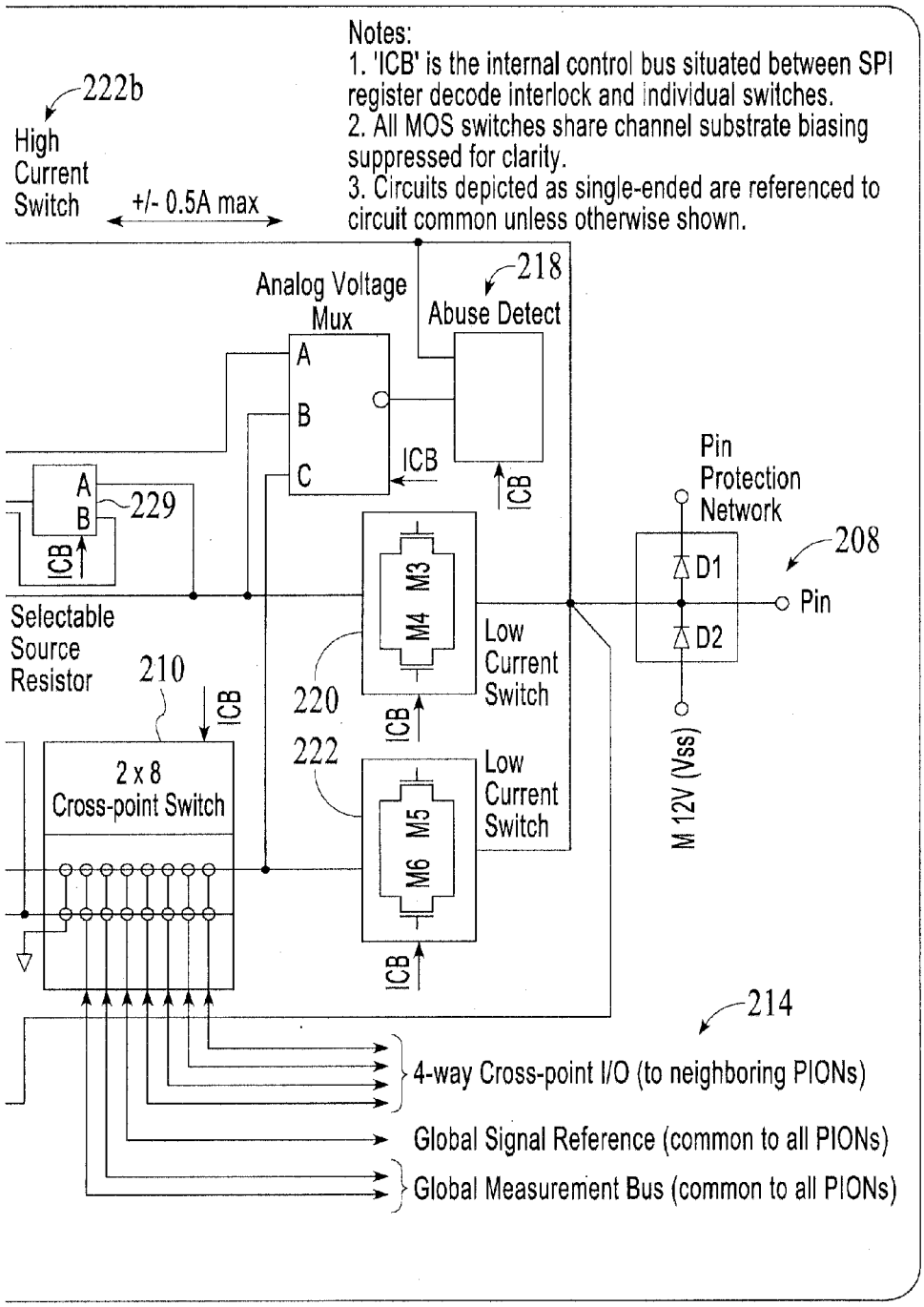

FIG. 13 is a block diagram of an integrated circuit capable of realizing the interface apparatus, 84. The integrated circuit 198 has been specifically designed to serve the role of the interconnection apparatus, thus it may be referred to as an Application Specific Integrated Circuit (ASIC). This ASIC is specifically designed to provide the functionality of the interconnection apparatus 83. At some point in the future, such an ASIC could become a standard product from an integrated circuit vendor. Therefore the term ASIC, as used herein, includes a standard integrated circuit designed to function as the interface apparatus. Furthermore, the term integrated circuit (IC), as it is used herein is intended to cover the following range of devices: ASICs, hybrid ICs, low temperature co-fired ceramic (LTCC) hybrid ICs, multi-chip modules (MCMs) and system in a package (SiP) devices. Hybrid ICs are miniaturized electronic circuits that provide the same functionality as a (monolithic) IC. MCMs comprise at least two ICs; the interface apparatus of the present invention may be realized by a MGM where the required functionalities are divided between multiple ICs. A SiP, also known as a Chip Stack MCM is a number of ICs enclosed in a single package or module. A SiP can be utilized in the current invention similarly to a MCM. In theory, programmable logic devices might be used to realize the interface apparatus of the present invention. However, currently available programmable logic devices, such as field programmable gate arrays (FPGAs), have a number of functional limitations that make their use undesirable—for example an FPGA cannot route power or ground to a given pin. Should FPGAs be extended to overcome these functional limitations then these improved FPGAs may be used as components to realize the interface apparatus 84.

FIG. 13 depicts a block diagram of a pin driver ASIC 198. When connected to the microprocessor 80 by a serial communication bus 206 such as an SPI interface, the microprocessor 80 of FIGS. 6 & 7 can command the ASIC 198 to perform the functions of the circuits of interconnection apparatus 83. Although the circuitry of FIG. 13 appears different from the interconnection apparatus 83, the ASIC 198 is capable of performing the same or similar required functions. Whereas FIG. 6 is a somewhat idealized diagram intended to convey the essence of the module of the invention, FIG. 13 contains more of the circuit elements that one would place inside an ASIC. Nonetheless, FIG. 13 implements all the circuit elements of FIG. 6. For example, FIG. 6 shows a digital-to-analog converter (D/A or DAC) connectable to the device communication connector 16. In FIG. 13, the digital-to-analog converter 226 is connected to the output pin 208 via the switch 220. The present invention also includes other circuit arrangements for an ASIC 198 for the same or similar purpose. Those skilled in the art will know how to design various such circuitry, and these are to be included in the present invention.

Exemplary features of the ASIC of FIG. 13 will now be briefly described. Power may be applied to pin 208 by closing high current switch 222*b* and setting the supply selector 227 to any of the available power supply voltages such as 24-volts, 12-volts, 5-volts, ground or negative 12-volts. Said available power supply voltages provide the required pull-in and sustaining voltage levels to drive the solenoid.

The ASIC can measure the voltage on pin 208 by closing the low current switch 222 and reading the voltage converted by the analog-to-digital converter 216.

The ASIC can measure the current supplied to pin 208 by way of the high current switch 222*b* by use of the multiple programmable current limiters 224 which contain current measurement apparatuses. Said current measurement is used to determine the solenoid inductance as well as to determine whether said solenoid coil is shorted or open.

The periodic variation in voltage to the solenoid which is used to determine solenoid inductance is most easily accomplished by slightly varying the voltage of the plurality of power supplies 81, said appropriate power supply being selected by supply selector 227. The step change in voltage to the solenoid which is used to determine solenoid inductance is most easily accomplished by momentarily changing the supply selector 227 to increase or decrease the solenoid voltage in order to increase or decrease the solenoid current in order to effect the measurement of solenoid inductance.

ASIC 198 has the ability to measure the amount of current flowing in or out of the node 208 labeled "Pin" in FIG. 13. The pin driver circuit 198 in this case uses its A/D converter 216 to measure current flowing into or out of the pin node 208, thereby enabling the detection of excessive current, or detecting whether a device connected to the Pin node 208 is functioning or wired correctly.

ASIC 198 also has the ability to monitor the current flow into and out of the pin node 208 to unilaterally disconnect the circuit 198, thereby protecting the ASIC 198 from damage from short circuits or other potentially damaging conditions. The ASIC 198 employs a so-called "abuse detect circuit" 218 to monitor rapid changes in current that could potentially damage the ASIC 198. Low current switches 220, 221 and 222 and high current switch 222*b* respond to the abuse detect circuit 218 to disconnect the pin 208.

The ASIC 198 abuse detect circuit 218 has the ability to establish a current limit for the pin 208, the current limit being programmatically set by the microprocessor 80. This is indicated by selections 224.

The ASIC 198 can measure the voltage at the pin node 208 in order to allow the microprocessor 80 to determine the state of a digital input connected to the pin node. The threshold of a digital input can thereby be programmed rather than being fixed in hardware. The threshold of the digital input is set by the microprocessor 80 using the digital-to-analog converter 226. The output of the digital-to-analog converter 226 is applied to one side of a latching comparator 225. The other input to the latching comparator 225 is routed from the pin 208 and represents the digital input. Therefore, when the voltage of the digital input on the pin 208 crosses the threshold set by the digital-to-analog converter, the microprocessor 80 is able to determine the change in the input and thus deduce that the digital input has changed state.

The ASIC 198 can measure a current signal presented at the pin node, the current signal being produced by various industrial control devices. The ASIC 198 can measure signals varying over the standard 4-20 mA and 0-20 mA ranges. This current measurement means is accomplished by the microprocessor 80 as it causes the selectable gain voltage buffer 231 to produce a convenient voltage such as zero volts at its output terminal. At the same time, the microprocessor 80 causes the selectable source resistor 228 to present a resistance to the path of current from the industrial control device and its current output. This current enters the ASIC 198 via the pin 208. The imposed voltage on one side of a known resistance will cause the unknown current from the external device to produce a voltage on the pin 208 which is then measured via the analog-to-digital converter 216 through the low current switch 222. The microprocessor 80 uses Ohm's Law to solve for the unknown current being generated by the industrial control device.

The ASIC 198 includes functions as described above in reference to the interface apparatus 84. For example, an ASIC 198 can include an interconnection apparatus 83 including a digital-to-analog converter 226, wherein the microprocessor 80 is programmable to direct the reception of a digital signal from the microprocessor 80 and cause the signal to be converted by the digital-to-analog converter 226 to an analog signal, and to place a copy of the analog signal on the pin 208. See FIGS. 6 and 13.

The ASIC 198 can also include an interconnection apparatus 83 including an analog-to-digital converter 216, and wherein the microprocessor 80 is programmable to detect an analog signal on any selected contact 16 and cause the analog-to-digital converter 216 to convert the signal to a digital signal and output a copy of the digital signal to the microprocessor 80.

The ASIC 198 can also include a supply selector 227, and a high current switch 222*b* positioned between the selector 227 and the pin 208. The microprocessor 80 is programmable to operate a supply selector 227 to cause a power supply voltage to be connected to a first contact 16, and to cause a power supply return to be connected to a second contact 16.

Referring to FIG. 13, there is a 2×8 cross-point switch 210, that serves to connect a sensor to two adjacent pins 208 which are in turn connected to two adjacent device communication connectors 16. The cross-point switch 210 allows a sensor such as a thermocouple to be connected to a precision differential amplifier 212. The precision differential amplifier 212 may be connected via the low current switch 222 and the 2×8 cross-point switch 210 to the 4-way cross-point I/O 214 and then to another 4-way cross-point I/O 214 on an adjacent integrated circuit 19 (the integrated circuit for an adjacent contact 16).

Other enhancements of the present invention include the ability of the module 15 to perform independent control of devices connected to the module 15. If, for example, a solenoid is connected to the module 15, then the microprocessor 80 can perform the required periodic or continuous measurement of inductance by causing the solenoid voltage to slightly vary and then measure the resulting current using the current measurement apparatuses in the programmable current limiters 224. In addition, said microprocessor 80 can perform the required steps to shut down the solenoid by throttling or recirculating the current. The module 15 can thereby perform all the functions required to actuate a solenoid and verify its state, whether sealed or open.

Referring to FIGS. 6 & 7, the microprocessor 80 is generally configured/programmed by a controller 85 to receive instruction from the controller as required to sense a particular state of a selected device such as solenoid inductance and/or actuate a selected device, such as solenoid 10, and provide the corresponding data to the system controller. The microprocessor 80 may also be programmed/directed by the controller to cause a particular signal to be applied to any selected one or more contacts 16. In addition, the microprocessor 80 is programmed to respond to direction to send a selected signal type from one or more of devices to the system controller. In other words, the microprocessor controls the configuration of the interface apparatus 84 and generally the microprocessor is controlled by the system controller. Alternatively, the interface apparatus can be configured in response to a message stored in the memory of the microprocessor 80 of the module 15.

In some embodiments, the microprocessor 80 has an embedded web server. A personal computer may be connected to the module 15 using an Ethernet cable or a wireless communication device and then to the Internet. Here the personal computer may also be a system controller. The embedded web server provides configuration pages for each device connected to the module 15. The user then uses a mouse, or other keyboard inputs, to configure the device function and assign input/output pins. The user may simply drag and drop icons on the configuration page to determine a specific interconnection apparatus for each of the contacts. In other embodiments, the microprocessor 80 uses a network connection to access a server on the Internet and receive from said server instructions to determine a specific interconnection apparatus for each of the contacts.

As an example of the operation of the module 15, the microprocessor 80 may be programmed to recognize particular input data, included for example in an Ethernet packet on a network cable connected to said microprocessor containing instructions to actuate a particular solenoid connected to said module 15.

The circuit switching apparatus (R1-R12) are shown diagrammatically as electromechanical relays. In one embodiment, this switching apparatus is realized in a semiconductor circuit. (See FIG. 13 and related description.) A semiconductor circuit can be realized far less expensively and can act faster than an electromechanical relay circuit. An electromechanical relay is used in order to show the essence of the invention.

While certain representative embodiments and details have been shown for purposes of illustrating the invention, it will be apparent to those skilled in the art that various changes in the methods and apparatus disclosed herein may be made without departing from the scope of the invention which is defined in the appended claims.

What is claimed is:

1. A method for operating a solenoid using a configurable, connectorized input/output module electrically connected to a coil of said solenoid, comprising the steps of:

(a) in response to a solenoid drive signal becoming true, connecting an actuation voltage and establishing an actuation current to the coil by said module, wherein said actuation voltage and actuation current cause said solenoid to close or seal;

(b) on closing or sealing said solenoid, changing to a sustain voltage and sustain current on the coil by said module, said sustain voltage or sustain current being less than said actuation voltage or actuation current and keeping said solenoid in a closed or sealed position; and (c) maintaining said sustain voltage and sustain current by said module;

wherein said module includes a device communication connector apparatus for connecting at least one conductor between said module and said solenoid, and an interface apparatus for causing said module to place any of a plurality of signals on any of a plurality of contacts of said device communication connector apparatus.

2. The method of claim 1, wherein said changing includes disconnecting said actuation voltage and actuation current from said solenoid and connecting said sustain voltage and sustain current to said solenoid by said module.

3. The method of claim 1, wherein said changing includes changing the voltage or current level of a single power supply.

4. The method of claim 1, wherein the sustain voltage or sustain current is less than fifty percent of the actuation voltage or actuation current.

5. The method of claim 1, further comprising removing power from said solenoid when said solenoid drive signal becomes false.

6. The method of claim 5, further comprising throttling the coil current and clamping the coil voltage with the module.

7. The method of claim 6, wherein said throttling continues until the voltage that said coil is capable of sourcing falls to less than the clamped voltage.

8. The method of claim 7, further comprising, after said throttling, connecting said coil to a fixed transistor drive by said module to dissipate remaining energy from said coil.

9. The method of claim 5, wherein said module provides a conductive path for dissipating energy from said coil by connecting both sides of said solenoid to the same power source, either high-side or low-side.

10. The method of claim 9, further comprising connecting said coil to a fixed transistor drive by said module to dissipate energy from said coil.

11. The method of claim 1, further comprising determining the state of said solenoid by said module, wherein said state includes shorted, jammed, and a range of states from open to closed or sealed.

12. The method of claim 11, wherein said determining includes measuring the inductance of the coil by said module.

13. The method of claim 12, wherein said determining includes measuring the inductance when said solenoid is open, measuring the inductance when said solenoid is closed or sealed, and storing the measurements in a memory of a microprocessor of said module.

14. The method of claim 12, wherein said measuring is continuous or periodic.

15. The method of claim 12, wherein said measuring includes applying a sinusoidal voltage signal to said coil by said module and measuring by said module the relative magnitude and relative phase of the coil current in reaction to the applied sinusoidal voltage.

16. The method of claim 12, wherein said measuring includes applying a square wave voltage signal to said coil by said module and measuring by said module the relative magnitude and relative phase of the coil current in reaction to the applied square wave voltage.

17. The method of claim 12, wherein said measuring includes applying a series of pulses to said coil by said module, measuring by said module the step responses over time of the coil current in reaction to the applied voltage pulses, and computing said inductance from said step responses.

18. The method of claim 11, further comprising continuously or periodically determining said state of said solenoid when said solenoid drive signal is true or false.

19. The method of claim 18, further comprising, if said solenoid is determined not to be closed or sealed, repeating said connecting, maintaining said actuation voltage and actuation current, changing, and maintaining said sustain voltage and current.

20. The method of claim 19, wherein said sustain voltage or sustain current is increased during said repeating.

21. The method of claim 1, wherein said interface apparatus includes at least one integrated circuit providing a selectable interconnection apparatus to a particular one of said contacts.

22. The method of claim 21, wherein said integrated circuit is an ASIC.

23. The method of claim 1, wherein said interface apparatus includes a microprocessor for causing said module to place any of a plurality of signals on any of a plurality of contacts of said device communication connector apparatus.

24. A configurable, connectorized input/output module for operating a solenoid, said module comprising:

a device communication connector apparatus for connecting at least one conductor between said module and said solenoid; and an interface apparatus for causing said module to place any of a plurality of signals on any of a plurality of contacts of said device communication connector apparatus, said interface apparatus including a memory for storing a computer program and a processor for executing said program, said program causing said processor to:

(a) in response to a solenoid drive signal becoming true, connect an actuation voltage and establish an actuation current to the coil by said module, wherein said actuation voltage and actuation current cause said solenoid to close or seal;

(b) on closing or sealing said solenoid, change to a sustain voltage and sustain current on the coil by said module, said sustain voltage or sustain current being less than said actuation voltage or actuation current and keeping said solenoid in a closed or sealed position; and (c) maintain said sustain voltage and sustain current by said module.

25. The module of claim 24, wherein said program causes said processor to measure the inductance of the coil by said module for determining the state of said solenoid, said state including a range of states from open to closed or sealed.

26. A system for operating a solenoid, said system comprising:

a configurable, connectorized input/output module comprising a device communication connector apparatus for connecting at least one conductor between said module and said solenoid and an interface apparatus for causing said module to place any of a plurality of signals on any of a plurality of contacts of said device communication connector apparatus; and a controller connected to said module by a communication link, said controller including a memory for storing a computer program and a processor for executing said program, said program causing said processor to switch a solenoid drive signal to true and send said signal to said module for said module to:

(a) connect an actuation voltage and establish an actuation current to the coil, wherein said actuation voltage and coil current cause said solenoid to close or seal;

(b) on closing or sealing said solenoid, change to a sustain voltage and sustain current on the coil by said module, said sustain voltage and sustain current being less than said actuation voltage or actuation current and keeping said solenoid in a closed or sealed position; and (c) maintain said sustain voltage and sustain current by said module.

27. The system as in claim 26, wherein said communication link is an Ethernet link.

28. The method of claim 11, further comprising reducing the current on a jammed solenoid by said module to reduce overheating.

* * * * *